United States Patent [19]

Gerry

[11] 4,317,343

[45] Mar. 2, 1982

[54] DRIVE ARRANGEMENT FOR A WASHING MACHINE

[75] Inventor: Otto F. Gerry, Louisville, Ky.

[73] Assignee: General Electric Company, Louisville, Ky.

[21] Appl. No.: 183,607

[22] Filed: Sep. 2, 1980

Related U.S. Application Data

[63] Continuation-in-part of Ser. No. 87,900, Oct. 24, 1979, abandoned.

[51] Int. Cl.[3] ..... D06F 13/02

[52] U.S. Cl. ..... 68/23.7; 74/785; 192/18 R; 192/93 A

[58] Field of Search ..... 68/23.6, 23.7; 192/18 R, 93 A; 74/785

[56] References Cited

U.S. PATENT DOCUMENTS

| | | | |
|---|---|---|---|
| 1,629,021 | 5/1927 | Culver | 74/785 |
| 2,040,654 | 5/1936 | Hougland . | |
| 2,200,870 | 5/1940 | Armbruster | 68/23.7 X |
| 2,301,046 | 11/1942 | Henderson | 68/23.7 |
| 2,399,319 | 4/1946 | Bowen et al. | 74/785 |
| 2,609,697 | 9/1952 | Ruscoe . | |
| 2,610,498 | 9/1952 | Geldhof et al. | 68/23.7 |
| 2,656,702 | 10/1953 | Chapin | 68/154 |
| 2,674,868 | 4/1954 | Williams . | |
| 2,834,229 | 5/1958 | Graybill | 74/785 X |
| 2,964,974 | 12/1960 | Loutrel . | |
| 2,976,746 | 3/1961 | Flannery | 68/23.7 X |
| 3,216,226 | 11/1965 | Alger et al. | 68/23 R |
| 3,216,227 | 11/1965 | Alger et al. | 68/23.7 |
| 3,264,847 | 8/1966 | Johnson et al. | 68/23.7 |
| 3,324,690 | 6/1967 | Button | 68/23.7 |
| 3,342,085 | 9/1967 | Brundage | 192/18 R X |
| 3,563,114 | 2/1971 | Casale | 192/18 R X |
| 3,584,482 | 6/1971 | Brucken | 68/23 R |
| 3,838,755 | 10/1974 | Cochran et al. | 68/23.6 X |
| 3,845,642 | 11/1974 | Cochran | 68/23.7 |
| 4,165,624 | 8/1979 | Ruble | 68/23.7 |
| 4,255,952 | 3/1981 | Johnson | 68/23.7 |

*Primary Examiner*—Philip R. Coe

*Attorney, Agent, or Firm*—Frank P. Giacalone

[57] ABSTRACT

A drive arrangement is disclosed for producing oscillation of a washing machine agitator and rotation of the basket for the spin cycle. The arrangement consists of a DC motor having an oscillating mode and a unidirectional rotation mode, the motor driving a mechanically shifted transmission, including a planetary gear set driving the washing machine agitator during the oscillation mode of the motor. A gear case is clutched to the washing machine basket during the spin cycle to produce direct drive of the basket during unidirectional rotation of the motor. The transmission shifter arrangement is operated by an incremental rotation of the drive motor which causes a cam follower-shifter member to be axially displaced from a neutral position to produce either a spin or agitate drive condition of the transmission. A dynamic braking arrangement of the washing machine drive motor is provided by switching in a load across motor armature leads to cause braking of the agitator and basket spin whenever the drive motor is not energized.

10 Claims, 6 Drawing Figures

DRIVE ARRANGEMENT FOR A WASHING MACHINE

CROSS-REFERENCE TO RELATED APPLICATION

This application is a continuation-in-part of application Ser. No. 087,900, filed Oct. 24, 1979, and now abandoned, the disclosure of which is hereby incorporated by reference.

BACKGROUND DISCUSSION

In conventional modern day washing machines of the top-loading type, there is typically provided an outer tub which holds the wash and rinse water.

Within the tub is disposed a perforate basket acting as a clothes-receiving receptacle and within the basket an agitator or impeller which is oscillated during the wash and sometimes during the rinse cycle in order to produce agitation and circulation of the clothing items in the water to produce thorough washing and rinsing action.

The basket is utilized to execute centrifugal extraction of the wash and rinse water from the clothing items during spin dry cycles. That is, the basket is rotated at a relatively high rate of rotation in order to cause centrifugal outward movement of the water from the basket into the outer tub. After being collected in the outer tub, the water is drained preparatory to initiation of another machine cycle.

The respective drives to the agitator and basket are commonly afforded by a transmission unit coupled to a single drive motor. The transmission in one mode produces high speed rotation of the basket for the spin cycle and in a reverse direction of rotation of the drive motor, a relatively slow speed oscillatory output of the transmission is created which is transmitted to the washing machine agitator to execute the necessary motion thereof.

The oscillatory output is commonly achieved by use of a mechanical movement which converts the unidirectional rotary motion of the drive motor into an oscillatory output of the agitator power shaft. The mechanical movement necessary is generally complex in configuration and represents a relatively costly item in the transmission. Furthermore, the movement typically creates an unbalanced force which induces vibration.

In copending application Ser. No. 083,435, filed Oct. 10, 1979; Ser. No. 077,784, filed Sept. 21, 1979; Ser. No. 077,776, filed Sept. 21, 1979, and Ser. No. 077,656, filed Sept. 21, 1979, there is disclosed an arrangement including a DC drive motor which is commutated so as to be capable of operating in two different modes. In the first mode, there is a cyclically reversing or oscillatory rotation of the output shaft and in a second mode, the motor operates to produce unidirectional rotation of the output shaft.

The use of this type of motor has the advantage when coupled with an appropriate transmission of allowing the elimination of the mechanical movement necessary to produce an oscillatory output, since such movement is directly produced by the motor itself.

A transmission must still be provided even when employing such a drive motor in order to provide the necessary reduction to the basket and impeller and the coupling connections of the motor output shaft to the respective elements, with the motor in its unidirectional rotation mode. A direct drive to the basket must be established since the basket spin is carried out at relatively high rotational speeds equal to the motor output speed.

In the reversing drive mode of the motor, drive is established to the agitator at a rate of rotation much reduced over the rate of rotation of the motor shaft.

Furthermore, the basket itself is preferably braked during agitation such that the basket does not tend to react to the agitation of the wash load which causes it to slowly rotate in the opposite direction and reduce the effectivenss of the washing action.

This latter result arises since the clothing items engage the basket inside surface and are circulated by contact therewith and the agitation of the clothing items would be reduced in the event the basket was allowed to freely rotate in reaction to the agitator motor.

Such transmissions should preferably be of minimum cost, and the shifting arrangement should therefore be relatively simple while being highly reliable, not requiring complex and costly shifting components in order to shift between the neutral, agitation and spin drive conditions of the washing machine.

Also, such transmissions should preferably include a neutral condition in order to enable the drive of the recirculation or drain pumps, without rotation of the agitator or basket.

The transmission furthermore should be properly insulated from the heat of the hot water in the tub since such heat could result in an increased rate of wear of the components.

Also, the gearing and bearing components required to be submerged in oil should be enclosed within a housing of minimum volume.

Another highly desirable feature is the serviceability of the drive arrangement, i.e., the ease with which the unit may be removed from the machine is a major factor relating to the serviceability of the unit by maintenance personnel.

Normally, a mechanical safety brake is applied automatically to the basket, i.e., when the machine lid is open, the drive motor is deenergized and the basket braked to a stop within a short interval in order to minimize the possibilities of accidental injury due to contact with the basket while it is in motion. It would of course be highly desirable if the mechanical brake were not necessitated in order to provide this safety feature. Such mechanical brake would represent a substantial cost item.

Similarly, a mechanical clutch is generally interposed between the drive motor and transmission to enable the motor to develop the full speed prior to completely assuring the load which adds to the cost and complexity of the drive.

Accordingly, it is an object of the present invention to provide a drive arrangement including the above-described type of drive motor which is capable of operating in either an oscillatory or unidirectional drive rotary output mode and which includes a transmission for coupling such drive motor alternately to the washing machine agitator and basket in the respective drive modes.

It is another object of the present invention to provide such transmission which is shifted between neutral, agitate and spin drive modes by a relatively simple and reliable shifter mechanism.

It is still a further object of the present invention to provide such transmission in which there is provided an alternate drive through a gear reduction means in an agitate drive mode, and through a direct drive during the spin drive mode of the drive motor.

It is yet another object of the present invention to provide such gearing which is isolated from the tub in order to insure operation at relatively moderate temperatures and which also includes an arrangement for providing air cooling of the transmission to dissipate the heat generated during the drive cycles.

It is a further object of the present invention to provide an arrangement for using dynamic braking of the drive arrangement without the necessity of employing a mechanical brake which is capable of braking the basket upon deenergization of the drive motor in order to provide the above-described safety feature.

It is still a further object of the present invention to provide an arrangement in which the gearing housing filled with lubricating oil is of minimal volume.

It is still another object of the present invention to provide such transmission in which the basket is restrained against rotation during the agitation cycle.

SUMMARY OF THE INVENTION

These and other objects of the present invention, which will become apparent upon a reading of the following specification and claims, are achieved by a combination of a transmission and a drive motor, preferably of the DC electronically commutated type disclosed in the aforementioned patent applications, and having a first mode of operation in which there is a cyclically reversing rotation of the motor shaft and a second drive mode in which there is a unidirectional rotation of the motor shaft.

The transmission according to the present invention is driven by the DC motor so as to alternately cause the agitator to be oscillated at a reduced rotational rate during the reversing output drive mode of the motor, and to be coupled directly to the washing machine basket during the unidirectional rotation drive mode of the DC motor.

The transmission comprises a planetary gear set contained within a gear case, with the output of the planetary gear set being connected to the agitator power shaft to produce a reduced speed drive of the agitator during the oscillatory mode of the DC drive motor. The gear case is directly coupled to the basket and rotated during the basket spin cycle by the unidirectional rotation of the DC drive motor.

The planetary gear set includes an input drive pinion or sun gear which is driven by the motor during the agitation cycle and which sun gear drivingly engages the larger diameter section of a plurality of stepped planetary gears, each having a small diameter section in mesh with an encircling ring gear, secured to the gear case to be rotationally fixed thereto. A planetary output carrier rotatably mounts the stepped planetary gears, and is directly coupled to the agitator power shaft.

The gear case is braked during the agitation cycle in order to provide a reaction for the planetary gear set to generate the reduced drive output through the planetary gearing. During the basket spin drive mode, the connected gear case and ring gear are released for free rotation, and the input pinion gear and ring gear are coupled together such that the planetary gear set rotates as a unit to produce direct drive between the drive shaft and the basket.

A power shifter arrangement is provided to change the drive condition of the transmission between neutral, spin and agitate modes.

In the neutral position, the power shifter arrangement includes an idler cam element rotatably mounted on the motor or drive shaft and a cam follower-shifter element mounted opposite the idler cam element. The cam follower-shifter element is adapted to be coupled to the motor or drive shaft in the first, neutral position via an internal slide, but disconnected from the remaining components of the transmission. The cam follower-shifter element includes a protuberance formed thereon which is positioned opposite a circumferential cam surface formed on the idler cam element so that both of these elements rotate together in the neutral rotation of the motor unless the idler cam element is braked.

After stopping of the drive motor preparatory to initiation of a change to the next cycle in the washing machine, and upon activation of a braking solenoid to the idler cam element, the drive motor is stepped through a predetermined angular displacement. The relative motion between the now relatively fixed idler cam element and the configuration of the mating idler cam contour is such as to produce an axial shifting of the cam follower-shifter element.

The axial shifting causes the shifter element to move into a driving engagement with the pinion or sun gear driven by the transmission input shaft, and at the same time into a driving engagement with the spin tube coupled to the gear case element to produce drive upon initiation of the drive motor, directly to the basket via the gear case.

Upon cessation of rotation of the drive motor and stepping of the motor with the free running cam element braked, additional axial shifting of the cam follower-shifter element moves the cam follower-shifter element out of engagement with the spin tube and into engagement with a spin tube ground connect member, which is rotatably connected to the spin tube while being axially movable thereon.

The spin tube ground connect member is moved into engagement with teeth formed on a relatively fixed bearing housing which mounts the gear case enclosing the planetary gear set, with an air space therebetween. This produces the braking of the ring gear such that upon initiation of the drive of the drive motor, a reduced rate oscillatory drive through the transmission results.

The power shifting of the cam follower-shifter element is produced by the stepping rotation of the motor such that relatively great axial movement of the shifter element with a high actuation force is produced, without the necessity for a relatively large shifting solenoid. In effect, the stepping rotation of the drive motor is utilized to generate the actuation force.

The cam follower-shifter element is spring biased into the neutral position, while the spin tube ground connect member is spring biased out of engagement with the bearing mounting housing.

The gear case is enclosed and sealed in order to confine a quantity of lubricating oil with a minimum volume, in order to lubricate the sun gear, planetary gears and output carrier.

The bearing mounting housing is configured to be spider-shaped in order to produce air cooling of the planetary gear set, which together with the air space therebetween acts to minimize the heat transfer from the tub water into the gear case and to thereby minimize the operating temperature of the gear set.

The planetary gears may be constructed of molded plastic since the number of planetary gears may be stepped in configuration and reduce the gear operating stresses as well as the moderate operating temperature of the planetary gear set.

The direct drive during the spin cycle driving through is directly through the gear case rather than through the gear set to avoid shock stressing of the gears by the dynamic braking of the basket and deenergization of the motor.

The dynamic braking is achieved by a switching arrangement which switches in an electrical load across the motor armature windings which generate a dynamic braking by the motor itself which obviates the necessity for a separate mechanical brake and produces dynamic braking of the motor whenever the DC motor is deenergized.

The entire unit operates with minimal vibration and is balanced such as to allow intimate tub and basket configuration.

The motor, transmission and circulation pump are mounted as a unit to the basket tub such as to enable removal of the entire drive unit by relatively simple procedure allowing ready replacement of the unit and testing of the unit outside of the machine in order to facilitate maintenance.

The drive arrangement allows the elimination of the usual centrifugal clutch since the DC drive motor itself is capable of generating relatively high starting torque.

DETAILED DESCRIPTION

In the following detailed description, certain specific terminology will be utilized for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
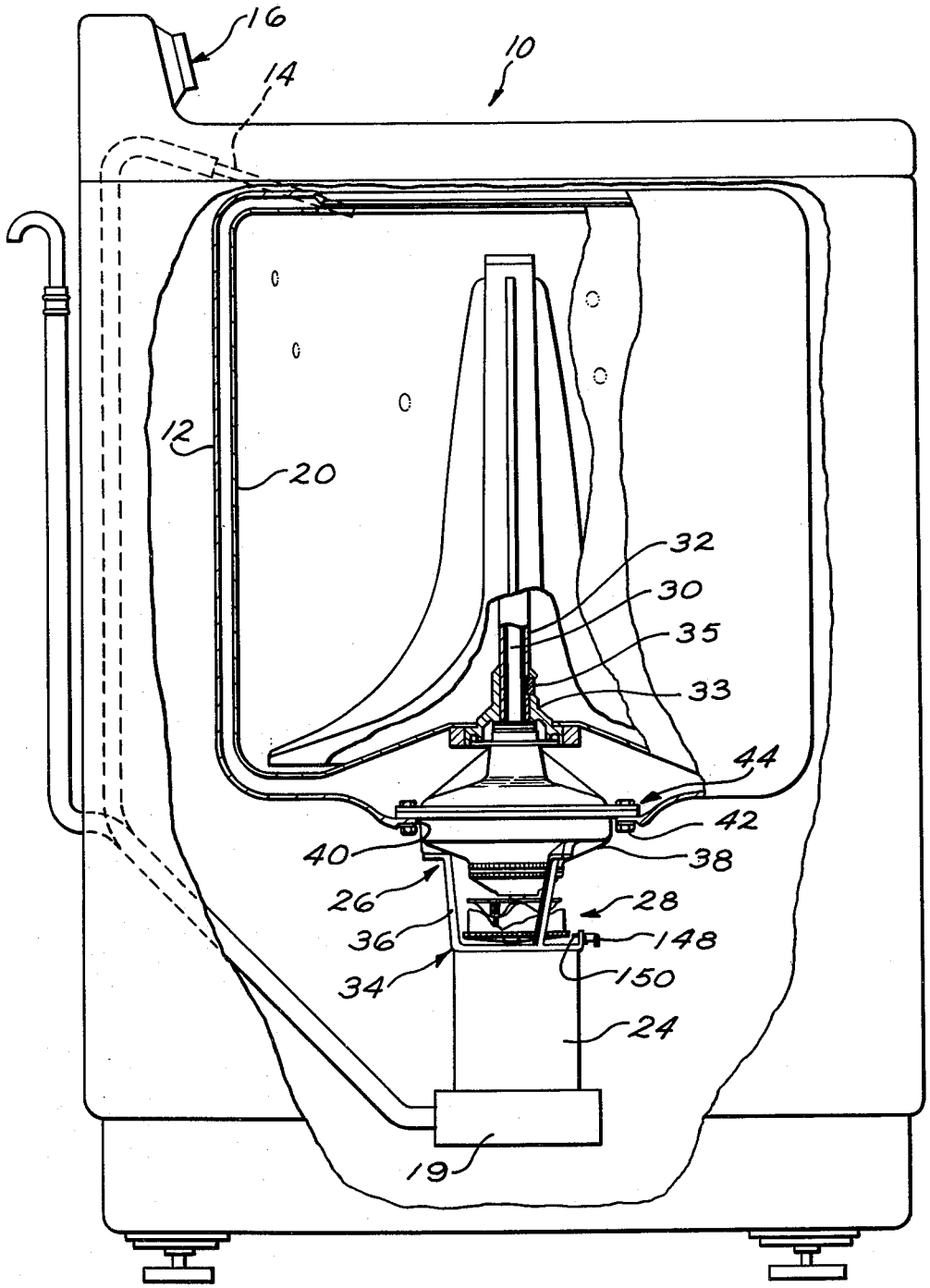
FIG. 1 is a side elevational view of a washing machine according to the present invention with portions of the cabinetry broken away to reveal the general arrangement and installation of the drive according to the present invention and with some components omitted for the sake of simplicity.

Referring to the drawings and particularly FIG. 1, the drive arrangement according to the present invention has particular application to a clothes washing machine. The washing machine 10 is of the top-loading type and is provided with an outer tub 12 adapted to be filled with wash or rinse water as via a fill tube 14, by operation of the machine controls indicated generally at 16 controlling the solenoid fill valves (not shown) in conventional fashion.

The water after each wash and rinse cycle is caused to be pumped into an external pump drain conduit 18, also in conventional fashion by a drain pump 19.

Within the outer tub 12 is mounted a basket 20 which acts as a clothes receiving receptacle and is generally perforate in order to provide for centrifugal extraction of the liquid upon high speed rotation thereof during the spin cycle of the machine.

Disposed within the clothes receiving basket 20 is an agitator 22 centrally located within the basket. The agitator is adapted to be oscillated during the wash and rinse cycles in order to provide agitation of the wash or rinse water and the clothing items disposed within the basket 20.

According to the present invention, the overall drive mechanism arrangement includes a DC drive motor 24 which drives through the transmission indicated generally at 26 with a power shifter mechanism 28 causing the transmission to be in one of a neutral, agitator or spin drive contions. The transmission 26 as will be explained in detail hereinafter drives a power shaft 30 on which agitator 22 is mounted and a spin tube 32 to which the basket 20 is secured.

In the agitate mode, the agitator 22 and power shaft 30 are oscillated by the DC drive motor 24 at a reduced rate of rotation relative to the rotation of the output shaft of the DC drive motor 24.

In the spin mode, the washing machine basket 20 is driven through a spin tube 32 at a direct drive from the DC drive motor 24 output shaft in a unidirectional direction in order to provide the spin cycle of the washing machine 10.

The DC drive motor 24 may also provide the drive for the pump 19 which is required in order to enable pump out of the water from the outer tub 12 into the external pump drain conduit 18.

Figure 2:
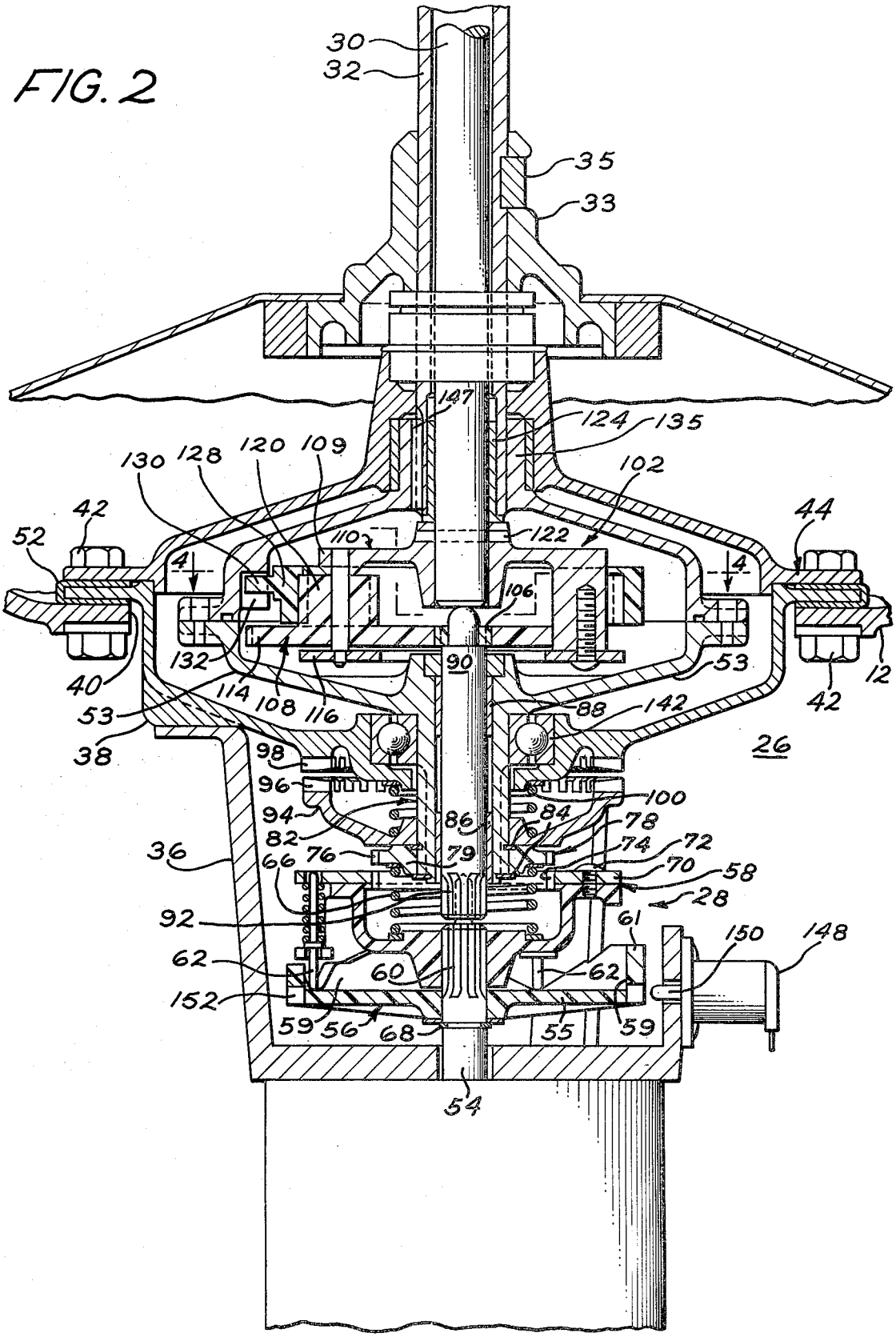
FIG. 2 is an enlarged partially sectional view of the transmission portion of the drive unit of the machine in FIG. 1, revealing certain details thereof.

The pump 19 is secured directly to the lower end of DC drive motor 24 housing, while the motor itself is mounted by bracket 34 which includes a series of straps 36 secured between the top of DC drive motor 24 and the housing 28 forming part of the transmission 26. The mechanism including basket 20, agitator 22, transmission 26, shifter 28 and motor 24 is mounted in a central opening 40 of outer tub 12 in the following manner. The housing 38 as shown in FIG. 2 is mounted to opening 40 in the bottom of the outer tub 12 by nuts and bolts 42 passing through a peripherally arranged flange 44 of the housing 38. A gasket 52 is provided to seal the opening 40 in the outer tub 12 receiving the housing 38.

Accordingly, it can be seen that the entire mechanism of washing machine 10 including transmission 26, shifter 28, motor 24 and pump 19 may be released and lifted upwardly simply by removal of the nuts and bolts 42 and connecting wiring and tub drain tube (not shown).

Spin tube 32 is coupled to the basket 20 by means of a mounting flange member 33 secured to the basket 20 and keyed at 35 to the spin tube 32. The outer tub 12 which supports the mechanism may in turn be mounted on a suspension system (not shown) in a manner well known to those skilled in the art.

Referring to FIG. 2, the details of the transmission 26 including a gear case 53 adapted to drive spin tube 32 in a manner to be fully explained hereinafter and the power shifter mechanism 28 are depicted. A drive shaft 54 is provided, either constituted by the motor shaft as shown, or driven by the DC drive motor 24 via intermediate gearing driven by the motor shaft. Mounted on drive shaft 54 is a rotatably mounted idler cam element 56. A snap retainer 68 is provided which axially locates the idler cam 56. Idler cam element 56 is generally cup-shaped and includes a base or bottom cylindrical portion 55 disposed concentrically to the drive shaft 54, and a circumferentially axially extending cam portion 59 which includes a cam contour face 61 which undulate axially from its axially disposed end.

The drive shaft 54 also mounts a cam follower-shifter element 58 which is rotatably joined to the drive shaft 54 being axially slidable therein by a splined engagement 60 with the drive shaft 54.

The cam follower-shifter element 58 is formed with a circumferentially downwardly extending cam follower 62 whose operation relative to cam face 61 will be described hereinafter in further detail with reference to FIG. 3. In the present embodiment, three cam followers 62 are provided and the contours on cam face 61 are repeated in the same relative axial relationship relative to the element 56.

A compression spring 66 engages a radial face of the cam follower-shifter element 58 urging the same downwardly into engagement with the idler cam 56 and, more particularly, followers 62 relative to cam face 61.

The cam follower-shifter element 58 is further formed with an annular plate 70 secured by means of machine screws 72 to be rotatably fixed relative thereto and having internal diameter teeth indicated at 74. The teeth 74 are dimensioned to mesh with external teeth 76 formed on a spin tube male connect element 78 in a manner to be explained later.

The spin tube male connect element 78 is secured by interconnecting spline 79 to an input hub portion 82 extending from the lower end of gear case 53 so as to be rotatably fixed relative thereto. Retainers 84 axially retain the spin tube male connect element 78 on the gear case extension 82.

Sleeve bearings 86 and 88 provide a rotational mounting of the gear case 53 at extension 82 on an input member or shaft 90. Input shaft 90 is axially aligned with the drive shaft 54 and immediately adjacent the end thereof.

Figure 5:
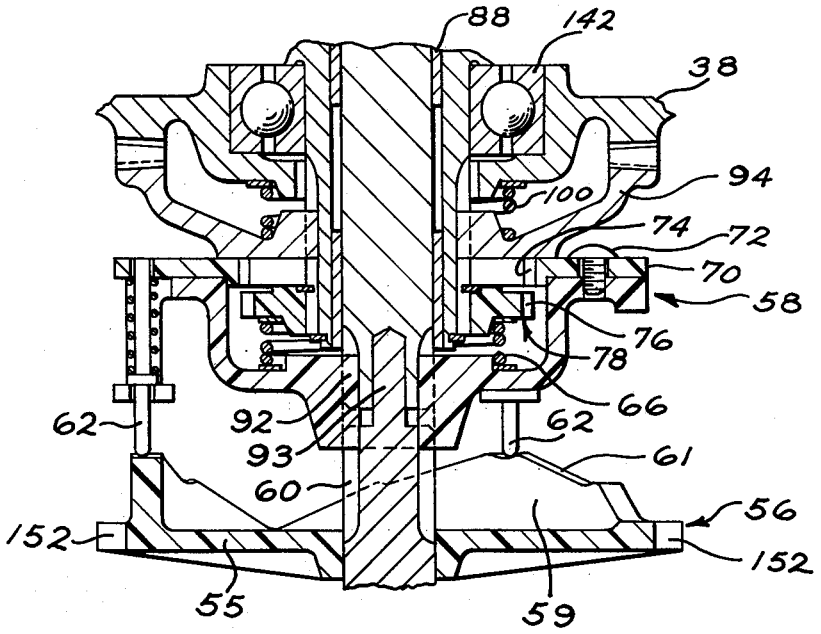
FIG. 5 is an enlarged vertical view in section showing, in detail, the shifting mechanism of the present invention.

The lower end portion of shaft 90 protruding from extension 82 is provided with a spline 92 which corresponds to the spline 60 formed on the drive shaft 54. This arrangement enables the coupling together of the input shaft 90 and shaft 54 by element 58 when the cam follower-shifter element 58 is in an upwardly axially shifted position on spline 60 as will be described hereinafter as shown in FIG. 5. To insure that splines 60 and 92 line up, a locating pin 93 extending from shaft 54 engages an appropriate aperture in the bottom of shaft 90.

Also rotatably joined to the splined portion 79 of housing extension 82, while being axially movable thereon, is a spin tube ground connect element 94. Element 94 is generally cylindrical and formed with radially extending teeth indicated at 96 which are normally disposed opposite corresponding teeth 98 formed on an end face of the lower segment of housing 38. Engagement of teeth 96, 98 grounds or locks gear case 53 through its extension 82 to the stationary housing 38 to prevent rotational movement thereof.

A compression spring 100 urges the spin tube ground connect 94 downwardly against the axially secured element 78 as viewed in FIG. 2 and its teeth 96 away from engagement with the opposite corresponding teeth 98 on housing 38.

Figure 4:
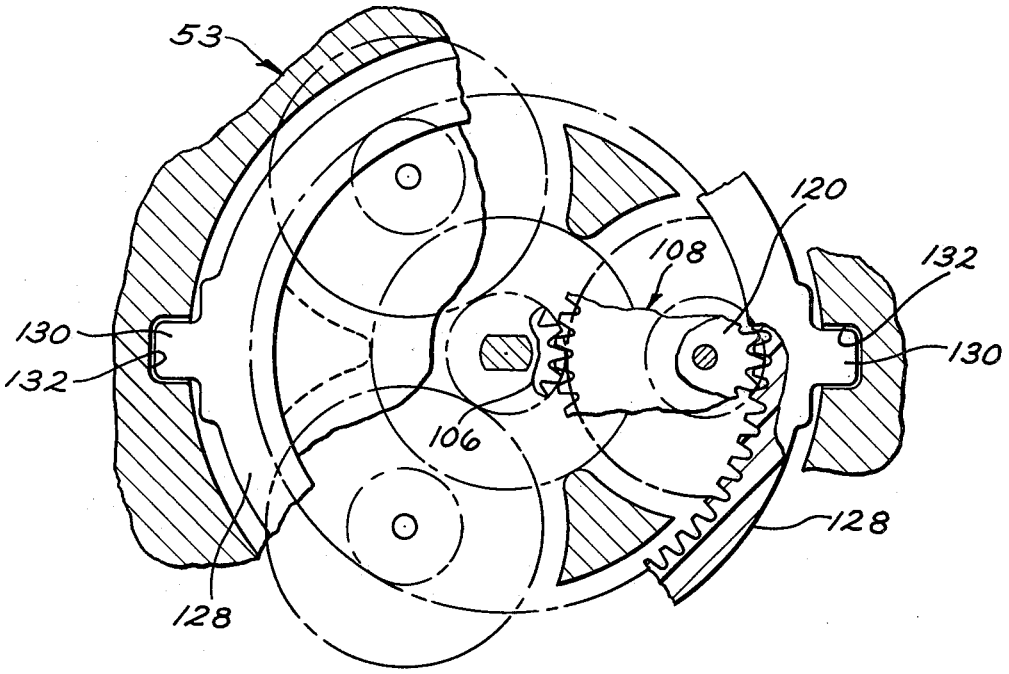
FIG. 4 is a plan view taken along lines 4—4 of FIG. 2 showing the gear reduction means employed by the present invention.

Gear reduction means shown in the plane view of FIG. 4 is provided which in the present embodiment comprises a planetary gear set 102 which is mounted within the gear case 53 integral with the gear case extension 82 so as to rotate together therewith. Referring now to FIG. 4, the planetary gear set 102 consists of the input gearing, i.e., sun gear 106 machined on the upper end of input shaft 90. Also included is a plurality of stepped pinion gears 108 which are rotatably mounted on a carrier assembly 110 including an upper frame portion 109 and a lower plate 116 by means of axle pins 112.

The stepped pinion gears 108 include a lower large diameter gear section 114, each of which is in mesh with the input pinion or sun gear 106, and an upper smaller diameter gear section 120 each of which is in mesh with a ring gear 128.

In the present embodiment, three sets of stepped pinion gears are contemplated for a typical application. The carrier assembly 110 is affixed to the agitator power shaft 30 by means of a cross pin 122 extending through a hub portion of the carrier assembly 110 and the agitator power shaft 30 which extends into a central bore formed in the carrier assembly 110. The agitator power shaft 30 is rotatably supported in an extension or hub 135 formed in the upper portion of the gear case 53 by a sleeve bearing 124. The ring gear 128 is rotatably fixed with respect to the housing by a series of fingers indicated at 130 received in corresponding pockets 132 formed in the gear case 53. In the present arrangement, reduced speed rotational movement to shaft 30 is imparted through the planetary gear set 102. As mentioned hereinbefore, the shaft 30 is oscillated by the D.C. drive motor 24 that is by the alternate rotational action of the motor.

The gear case 53 is rotatably supported relative to the housing 38 at its lower end by a ball bearing 142 which is mounted between the extension 82 and a bearing retaining area formed in the lower portion of housing 38.

Spin tube 32 at its lower end is received within the hub 135 and keyed thereto at 147 such as to be rotatably joined thereto. Thus, the gear case 53 is rotatably fixed to the spin tube 32. As mentioned hereinbefore, the transmission may be placed in any one of three modes, the neutral, spin or agitate. The mode selection is made by positioning the shifter element 58 axially relative to the spin tube connect member 78 and ground connect element 94. To this end, the idler cam 56 is held while the element 58 allowed to rotate and accordingly position itself circumferentially relative to the cam 56 in a manner to be explained in detail.

In order to selectively hold the idler cam 56, an electrical shifting solenoid 148 is provided which has a brake plunger 150 which will be extended upon energization of the electrical shifting solenoid 148 into engagement with teeth 152 formed circumferentially along the lower outer wall of element 56 so as to restrain the idler cam 56 from rotation. It should be noted that solenoid 148 is energized when motor 24 is deenergized. With the plunger 150 in this locked position, relative teeth 152, the motor 24 is pulsed to rotate element 58 relative thereto.

Figure 3:
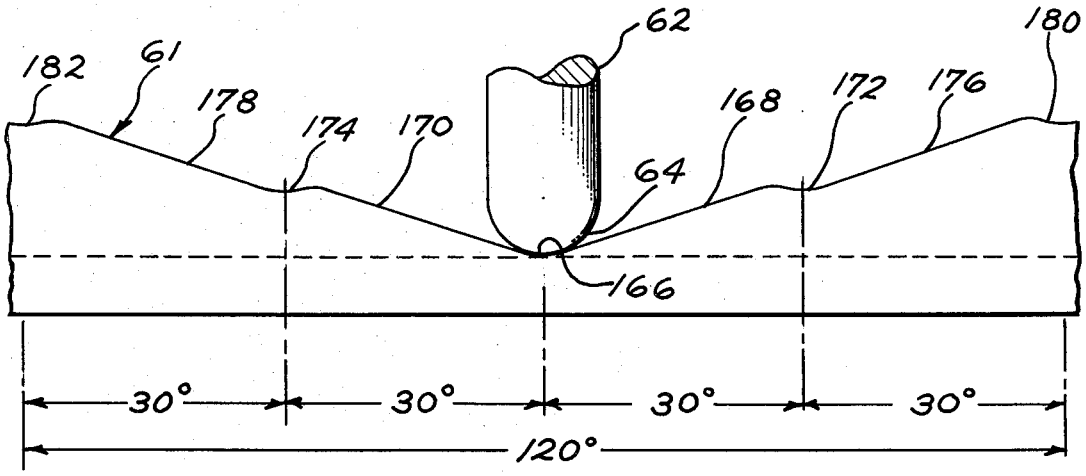
FIG. 3 is a development of the cam contour included in the cam follower-shifter element and idler cam element incorporated in the power shifter included in the transmission depicted in FIG. 2.

Referring to FIG. 3, a 120° cam segment of the developed cam profile 61 of the cam portion 59 of idler cam element 56 and a cooperating cam follower 62 of shifter element 58 are depicted which detail the respective engaging cam contours 61 formed on these elements. It should be noted that element 58 is provided with three resiliently arranged cam followers 62 that may yield axially under certain torque conditions as each follower 62 rides a corresponding cam surface in its respective 120° segment of cam portion 59. While there is shown three circumferentially spaced cam segments and cam followers, it should be understood that the exact number is a matter of design choice and, accordingly, the present invention can be carried out using other numbers of cams and followers that provide a balanced system. The axial contouring of each cam segment is such as to produce corresponding axial movement of the cam follower-shifter element 58 at 30° increments to establish the neutral, spin and agitate drive conditions of the transmission.

The contours are such as to cause the corresponding axial relative movement of element 58 upon relative angular displacement between the cam followers 62 and the idler cam 56 of a predetermined extent. Since the idler cam 56 is rendered axially stationary by the snap retainer 68, the relative axial movement results in an axial shifting of the cam follower-shifter element 58 when the DC motor 24 is pulsed during the time brake plunger 150 is in engagement with a respective tooth 152 of element 56. As stated above, the cam follower-shifter element 58 comprises a plurality of spring loaded cam followers 62 each having a rounded end 64 which rides on the corresponding cam surface 61 formed on the idler cam 56 end face. The cam surface 61 in each 120° segment includes a central depression or valley 166 adjacent ramp surfaces 168 and 170, respectively. The valley 166 represents the furthest downward position of the cam follower-shifter element 58 as viewed in FIG. 2. This position corresponds to the neutral drive condition. In this neutral or idle position, rotational movement of motor shaft 54 is imparted to shifter element 58 which, in this position, is not drivedly connected to the transmission 26.

Upon activation of the shifter solenoid 148, and engagement of the brake plunger 150 with a tooth 152 of member 56 and stepping rotation of the DC drive motor 24, the cam followers 62 move circumferentially relative to the idler cam 56 such as to climb either of the ramp surfaces 168 or 170 to cause camming and upward axial movement of the cam follower-shifter element 58. This repositions the cam follower 160 at a point whereat a second depression or valley 172 or 174 is reached, which provides a detented retention of the elements at this position.

In this position, teeth 74 of the cam follower-shifter element 58 have moved into engagement with the teeth 76 of the spin tube male connect element 78 which establishes spin drive to the basket 20 through the gear case 53. As explained above, the spin tube male connect element 78 is rotatably fixed to the extension 82 of gear case 53 through spline 79 which, in turn, is rotatably fixed to the spin tube 32 by key 147. Accordingly, rotation of the motor is imparted directly to the spin tube 32 and the basket 20 fixed thereto. In operation, spin is imparted to the basket 10 through the engagement of gear teeth 74 and 76. The teeth 74 on plate 70, which is driven by shaft 54, drives spin tube connect element 78 through teeth 76. As mentioned above, the element 78 is rotatably secured to the case 53 and, in turn, the case 53 is rotatably secured to the tube 32 to which is mounted the basket 20. At the same time, spline portion of element 58 engages the spline 92 formed on input shaft 90, it should be noted that in this mode, the drive between the shafts 54 and 90, while established through spline 92, is not significant during spin and is acceptable.

By further stepping angular displacement of a predetermined extent, i.e., 30°, by the DC drive motor 24 and engagement of the brake plunger 150, the cam follower 62 engages either one of the respective ramps 176 and 178 adjacent each of the depressions 172 and 174, respectively, to move into one of the second depressions 180 or 182 at the highest point of each cam segment.

The second depressions 180 and 182 are axially offset relative to the depressions 172 and 174 which relationship accordingly establishes a second, axially shifted position of the cam follower-shifter element 58, as seen in FIG. 5 in this position the teeth 74 are moved upwardly out of engagement with the external gear teeth 76, and into abutting engagement with the lower wall portion of element 94. This in turn advances element 94 axially upwardly on spline 79 causing the teeth 96 thereon to move into engagement with the teeth 98 formed on case 53. The engagement of teeth 98, 96 brakes or holds the gear case 53 against rotation through spline 79 on extension 82. It should be noted that while the case 53 is held against rotation, a drive to the input shaft 90 through engagement of splines 60 and 92 by the element 58 to thereby produce a reduced drive from the motor through the planetary gear set 102 to the agitator power shaft 30. Alternate rotational action of the DC motor with elements 56, 58 in this position provides the oscillating or agitating action of shaft 30.

Shifting is achieved by energizing solenoid 148 and appropriate stepping rotation of the DC drive motor 24 in either appropriate direction to enable movement of the cam followers 62 into any of the axially offset depressions formed along each cam profile segment. Shifting may also be accomplished by reverse rotation of the DC drive motor 24 which will thereby reposition the cam follower 62 relative to the contour of cam 61 to enable shifting to the agitate, spin or neutral positions, or from the spin position to the neutral position. It should be apparent from the above description of the transmission that the input hub portion 82 and the input shaft 90 in effect function as the input member to the transmission with regard to driving in one axial position of the shifter element through portion 82 for spin action, and in another axial position of the shifter element through the input shaft 90 for agitator action.

Figure 6:
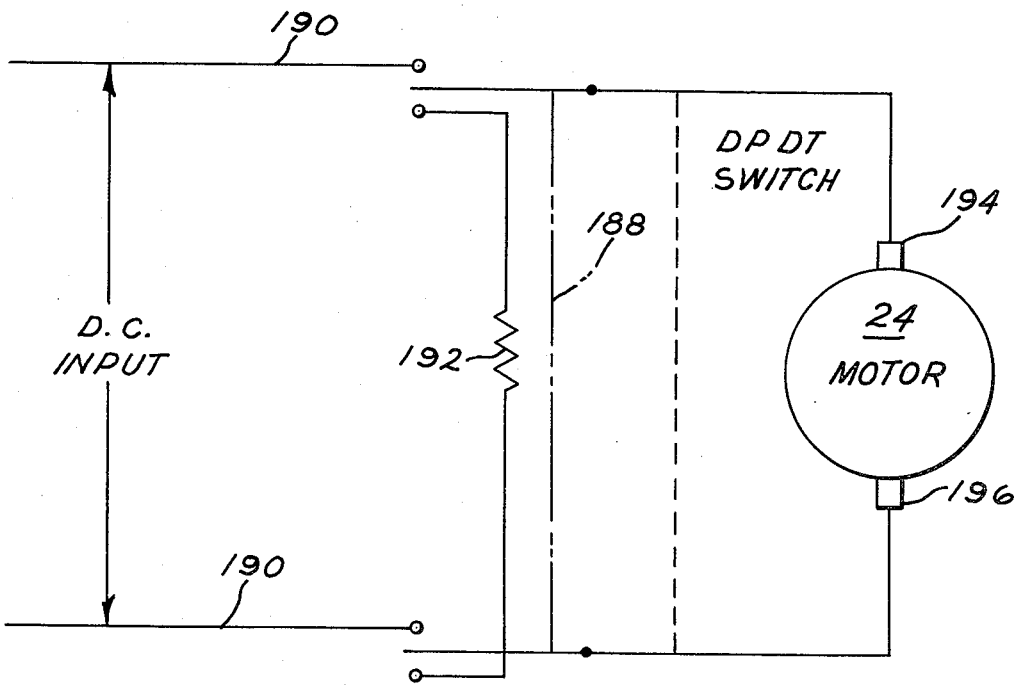
FIG. 6 is a diagrammatic representation of the dynamic braking circuit associated with the DC drive motor incorporated in the drive arrangement of the present invention.

Referring to FIG. 6, the circuit arrangement for producing dynamic braking of the DC drive motor 24 provides the necessary braking of the basket during the spin cycle. The DC drive motor 24 is as noted preferably of the permanent field magnet type. In this case, a strong braking action can be produced by converting the motor into a generator and connecting an electrical load across the generator such as to generate forces which can rapidly bring the basket 20 to a stop. This can be achieved by a double pole/double throw (DP/DT) switch indicated in FIG. 4 at 188 which either connects the DC drive motor 24 to line voltage across lines 190 to energize the DC drive motor 24 to alternately be connected across an electrical resistance 192. This opening of the DP/DT switch 188 may be by a tub cover switch or other arrangement.

The armature windings indicated at 194 and 196 are electrically placed in series with the electrical resistance 192 converting the DC drive motor 24 to a generator and creating the braking force acting on the basket 20 as noted above.

The braking force is applied through the gear case rather than through the gearing itself such that the dynamic braking load is not impressed on the gearing elements within the planetary gear set.

This thus eliminates the need for a separate mechanical brake of the friction brake for the basket 20, as well as an actuator therefor in order to provide the required safety brake on the basket 20.

Accordingly, it can be appreciated that the transmission drive arrangement achieves the above-recited objects of the invention by the arrangement in which the cyclically reversing drive of the DC drive motor 24 is converted into corresponding reduced speed oscillation of the agitator power shaft 30, and in which the unidirectional motor drive acts to product high speed rotation of the basket 20. This is by a relatively simple transmission which is compact in configuration and simple and reliable in operation.

The shifting of the transmission through the various modes is achieved by relatively lightweight, low cost solenoids since the power shifting is generated by the rotation of the drive motor itself. The complete package is easily removable as a package, i.e., the drive motor pump and transmission may be separately removed as a unit facilitating replacement and repair of the unit.

The spacing of the housing by the bearing mounting housing 38 produces insulation of the planetary gearing from the heat of the tub water and allows dissipation of the heat generated by drive through the unit such that low cost plastic gears are employed. The gear case housing is of minimal volume to reduce the quantity of lubricant required.

The basket is held securely during the agitate mode in order to maximize the efficiency of the agitate process by preventing rotation of the basket 20 during this cycle.

The basket spin operation is directly through the gear case rather than the planetary gear reduction, while the gear reduction is such as to produce relatively low loads carried by the individual gearing elements.

Finally, the need for separate mechanical brake and clutch is not required by this drive arrangement.

While the transmission arrangement is disclosed in particular important characteristics in the context of a washing machine transmission, it is to be understood that the transmission and power shifter may be employed in other transmission applications requiring these characteristics.

As noted above, the drive motor 24 may drive the drive shaft 54 through intermediate gearing (not shown) in order to reduce the starting load driving basket spin, to reduce the current during starting (protecting the solid state components) as well as to enable lower speed drain pump operation during basket spin.

It should be apparent to those skilled in the art that the embodiment described heretofore is considered to be the presently preferred form of this invention. In accordance with the Patent Statutes, changes may be made in the disclosed apparatus and the manner in which it is used without actually departing from the true spirit and scope of this invention.

What is claimed is:

1. A drive arrangement for a washing machine having an outer tub, a clothes receiving basket mounted within said tub and an agitator mounted within said basket, with a high speed rotation of the basket during a spin extraction cycle and relatively low rotational speed oscillation of said agitator to cause washing action of said clothing items disposed in said basket, the drive arrangement comprising:

drive motor means including a drive motor and a drive shaft driven by said drive motor means, said drive motor operable in first and second drive modes, wherein in said first mode, said drive shaft is rotated unidirectionally to effect said spin extraction cycle and in said second mode, said drive shaft rotation is cyclically reversed to cause oscillation of said agitator;

transmission means including a housing means rotatably connected to said basket being adapted to be driven in said first drive mode, and a reduction drive means including an input member arranged in said housing being connected to said agitator in said second drive mode to oscillate said agitator when said drive shaft is cyclically reversed;

means connecting said reduction gear means to said agitator; and, selectively operable shifter means including a shifter element mounted on said drive shaft for axial movement thereon while being rotatably connected thereto, said shifter means including means mounting said shifter element so as in a first position to decouple said drive shaft from said input member; in a second axially shifted position coupling said drive shaft to said input member to said reduction gear means, thereby establishing direct drive to said washing machine basket; and a third axially shifted position of said shifter element axially offset from said first and second positions of said shifter element decoupling from said reduction gear means while maintaining said coupling between said drive shaft and said input member; said shifter means further including means braking said housing means by said shifter element moving to said third position, whereby in said third axial position of said shifter element, said drive shaft is adapted to drive through said input member and said reduction gear means to drive said agitator at a reduced rate of rotation in said second drive mode thereby producing agitator drive, whereby oscillation of said agitator is achieved by driving said drive motor in said cyclically reversing mode and activation of said shifter means to produce said reduced drive through said reduction drive means to produce an oscillation of said agitator at a reduced rate of rotation and wherein with said drive motor in said unidirectional rotational mode and upon activation of said shifter means to drive said housing means, a relatively high speed unidirectional rotation of said washing machine basket is achieved.

2. The drive arrangement according to claim 1 wherein said shifter means further includes power shifter means including an idler cam element rotatably mounted on said drive shaft disposed opposite said shifter element and wherein said shifter element is formed with a cam contour correspondingly formed on said idler cam element in engagement therewith, said cam contours being configured to produce relative axial movement therebetween upon relative rotation between said idler cam element and said shifter element; retainer means retaining said idler cam element from moving axially away from said shifter element; selectively operable shifter brake means movable into engagement with said idler cam element mounted to rotatably restrain said idler cam element when operated; whereby said cam configuration moves said shifter element from said first axial position to said second axial position by a predetermined degree of angular displacement of said drive shaft, with said shifter brake means activated from said second axial position to said third axial position upon a predetermined degree of angular displacement of said drive shaft.

3. The drive arrangement according to claim 2 wherein said cam contours comprise axially varying circumferential contours in mating engagement and wherein one of said contours comprises an axially extending lobe carried by one of said elements and said other element being formed with a series of axial depressions, each corresponding to said first, second and third axial positions intermediate of said shifter element, with circumferentially extending ramping surfaces.

4. The drive arrangement according to claim 3 wherein said shifter means further includes spring means biasing said shifter element into engagement with said idler cam element.

5. The drive arrangement according to claim 4 wherein said shifter means includes an internal bore formed on said shifter element and wherein said drive shaft is aligned with and slidable within said bore, and further including means maintaining a driving engagement therebetween during axial movement of said shifter element on said drive shaft.

6. The drive arrangement according to claim 5 wherein said input shaft is aligned with said drive shaft and said shifter element, said shifter element slidable onto said input member in said second and third axial positions thereof and including means maintaining a rotatable connection therebetween in said second and third axial positions, whereby member establishing rotary connection between said drive shaft and said input in said second and third axial positions of said shifter element.

7. The drive arrangement according to claim 6 wherein said shifter element is further formed with coupling means formed thereon and further including corresponding coupling means connected to said housing means and wherein said shifter element coupling means and said corresponding coupling means move into coupling engagement upon movement of said shifter element from said first to said second position to produce said unitary drive to said washing machine basket.

8. The drive arrangement according to claim 7 wherein said shifter element further includes an abutment surface; and further including a brake grounding member rotatably joined to said housing means while being axially movable relative thereto, said braking grounding member having a corresponding abutment surface adapted to be engaged by said shifter element abutment surface upon movement thereof from said second axial position to said third axial position and further including brake engagement means formed on said grounding member and further including stationary engagement means positioned to be engaged thereby upon axial movement of said shifter element from said second to said third shifted position, and wherein said coupling means of said shifter element and said corresponding coupling means move out of engagement upon movement of said shifter element from said second to said third positions, and further including spring bias means acting on said braking member urging said braking grounding member out of engagement with said braking means.

9. The drive arrangement according to claim 8 wherein said DC drive motor comprises a permanent magnet DC drive motor and further including switching means, and an electrical resistance, said switching means connecting said electrical resistance across said DC motor windings upon deenergization of said motor, whereby dynamic braking is applied to said motor upon opening of said switching means.

10. The drive arrangement according to claim 9 wherein said rotational reduction drive means including a planetary gearing comprising an input shaft and an input gear connected thereto mounted for rotation, at least one planetary gear engaging said input gear, and a carrier rotatably mounted with said at least one planetary gear rotatably supported thereon;

reduction gear means in engagement with said at least one planetary gear secured to said housing;

means drivingly connecting said carrier to said washing machine agitator;

means drivingly connecting said motor output shaft to said input gear of said planetary gearing.

* * * * *